US007957966B2

(12) United States Patent
Takeuchi

(10) Patent No.: US 7,957,966 B2
(45) Date of Patent: Jun. 7, 2011

(54) APPARATUS, METHOD, AND PROGRAM FOR SOUND QUALITY CORRECTION BASED ON IDENTIFICATION OF A SPEECH SIGNAL AND A MUSIC SIGNAL FROM AN INPUT AUDIO SIGNAL

(75) Inventor: Hirokazu Takeuchi, Machida (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/700,503

(22) Filed: Feb. 4, 2010

(65) Prior Publication Data

US 2010/0332237 A1 Dec. 30, 2010

(30) Foreign Application Priority Data

Jun. 30, 2009 (JP) ..... 2009-156004

(51) Int. Cl.
*G10L 21/02* (2006.01)
*G10H 1/46* (2006.01)

(52) U.S. Cl. ..... 704/226; 84/711; 84/616; 381/56

(58) Field of Classification Search ..... 704/205–219; 84/616, 621; 381/56, 57, 110
See application file for complete search history.

(56) References Cited

U.S. PATENT DOCUMENTS 5,298,674 A * 3/1994 Yun ..... 84/616
5,375,188 A * 12/1994 Serikawa et al. ..... 704/215
6,570,991 B1 * 5/2003 Scheirer et al. ..... 381/110
7,130,795 B2 * 10/2006 Gao ..... 704/216
7,191,128 B2 * 3/2007 Sall et al. ..... 704/233
7,606,704 B2 * 10/2009 Gray et al. ..... 704/226
7,756,704 B2 * 7/2010 Yonekubo et al. ..... 704/226
7,844,452 B2 * 11/2010 Takeuchi et al. ..... 704/226
7,856,354 B2 * 12/2010 Yonekubo et al. ..... 704/226
7,864,967 B2 * 1/2011 Takeuchi et al. ..... 381/56
2003/0055636 A1 * 3/2003 Katuo et al. ..... 704/225
2008/0033583 A1 * 2/2008 Zopf ..... 700/94

FOREIGN PATENT DOCUMENTS

JP S61-93712 A 5/1986
JP 3-201900 9/1991
JP 7-13586 A 1/1995
JP 9-90974 A 4/1997
JP 2003-131686 5/2003
JP 2005-348216 12/2005
JP 2006-171458 A 6/2006
JP 2008-42721 2/2008
JP 2008-262000 10/2008

OTHER PUBLICATIONS

Japanese Office Action dated Mar. 16, 2010, Japanese Patent Application No. 2009-156004.
Japanese Office Action dated Jul. 13, 2010, Japanese Patent Application No. 2009-156004.

* cited by examiner

*Primary Examiner* — Abul Azad
(74) *Attorney, Agent, or Firm* — Patterson & Sheridan, LLP

(57) ABSTRACT

According to one embodiment, a sound quality correction apparatus calculates various feature parameters for identifying the speech signal and the music signal from an input audio signal and, based on the various feature parameters thus calculated, also calculates a speech/music identification score indicating to which of the speech signal and the music signal the input audio signal is close to. Then, based on this speech/music identification score, the correction strength of each of plural sound quality correctors is controlled to execute different types of the sound quality correction processes on the input audio signal.

7 Claims, 13 Drawing Sheets

| Sound quality correction type | Sound type | Maximum | Minimum | Front transition time | Rear transition time |
|---|---|---|---|---|---|
| Reverberation (sound quality corrector 78) | Music | Gain G: 1.0 | Gain G: 1.0 | T1f sec | T1b sec |
| Wide stereo (sound quality corrector 79) | Music | Gain G: 1.0 | Gain G: 1.0 | T2f sec | T2b sec |
| Center highlight (sound quality corrector 80) | Voice | Gain G: 1.0 | Gain G: 1.0 | T3f sec | T3b sec |
| Equalization (sound quality corrector 81) | Music | band 0 : A0dB<br>band 1 : A1dB<br>band 2 : A2dB<br>band 3 : A3dB<br>(Highlight low- and high -frequency bands) | band 0 : 0dB<br>band 1 : 0dB<br>band 2 : 0dB<br>band 3 : 0dB | T4mf sec | T4mb sec |

FIG. 13

APPARATUS, METHOD, AND PROGRAM FOR SOUND QUALITY CORRECTION BASED ON IDENTIFICATION OF A SPEECH SIGNAL AND A MUSIC SIGNAL FROM AN INPUT AUDIO SIGNAL

CROSS-REFERENCE TO RELATED APPLICATIONS

This application is based upon and claims the benefit of priority from Japanese Patent Application No. 2009-156004, filed Jun. 30, 2009, the entire contents of which are incorporated herein by reference.

BACKGROUND

1. Field

One embodiment of the invention relates to a sound quality correction apparatus, a sound quality correction method and a sound quality correction program to execute the sound quality correction process adaptively for a speech signal and a music signal contained in an audio signal (audio frequency) to be reproduced.

2. Description of the Related Art

As is well known, in the broadcast receiver configured to receive the TV broadcast and the information reproduction device configured to reproduce the recorded information, for example, the process of correcting the sound quality is executed on the audio signal reproduced from the received broadcast signal or the signal read from an information recording medium in order to further improve the sound quality.

The sound correction process executed on the audio signal in such a case is varied according to whether the audio signal is a speech signal representing the speech of a person or a music (non-speech) signal representing a musical composition. Specifically, the quality of the speech signal in a talking scene, the on the sport broadcasting, etc., is improved by executing the sound quality correction process in such a manner as to emphasize and clarify the center localization component, while the sound quality of a music is improved by executing the sound quality correction process on the music signal in such a manner as to secure the expansion by emphasizing the stereophonic effect.

For this purpose, a technique has been studied whereby whether the acquired audio signal is a speech signal or a music signal is determined and, in accordance with the result of this determination, a corresponding sound quality correction process is executed. In the actual audio signal, however, the speech signal and the music signal often are mixed, and the process of identifying them is difficult. Under the circumstances, therefore, no appropriate sound quality correction process is executed on the audio signal.

Jpn. Pat. Appln. KOKAI Publication No. 7-13586 discloses a configuration in which the input sound signal is classified into three types including a "speech", a "non-speech" and an "undetermined" by analyzing the zero-crossing rate and the power fluctuation thereof, so that the frequency characteristic of the sound signal is maintained at a characteristic emphasizing the speech band upon determination as a "speech", a flat characteristic upon determination as a "non-speech", and the characteristic determined in the preceding session upon determination as an "undetermined".

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

FIG. 13 is a diagram for describing a table used by the sound quality correction processing module to set the strength of sound quality correction according to the same embodiment;

DETAILED DESCRIPTION

Various embodiments according to the invention will be described hereinafter with reference to the accompanying drawings. In general, according to one embodiment of the invention, a sound quality correction apparatus calculates various feature parameters for identifying the speech signal and the music signal from an input audio signal and, based on the various feature parameters thus calculated, also calculates a speech/music identification score indicating to which of the speech signal and the music signal the input audio signal is more proximate. Then, based on this speech/music identification score, the correction strength of each of plural sound quality correctors is controlled to execute different types of the sound quality correction processes on the input audio signal.

Figure 1:
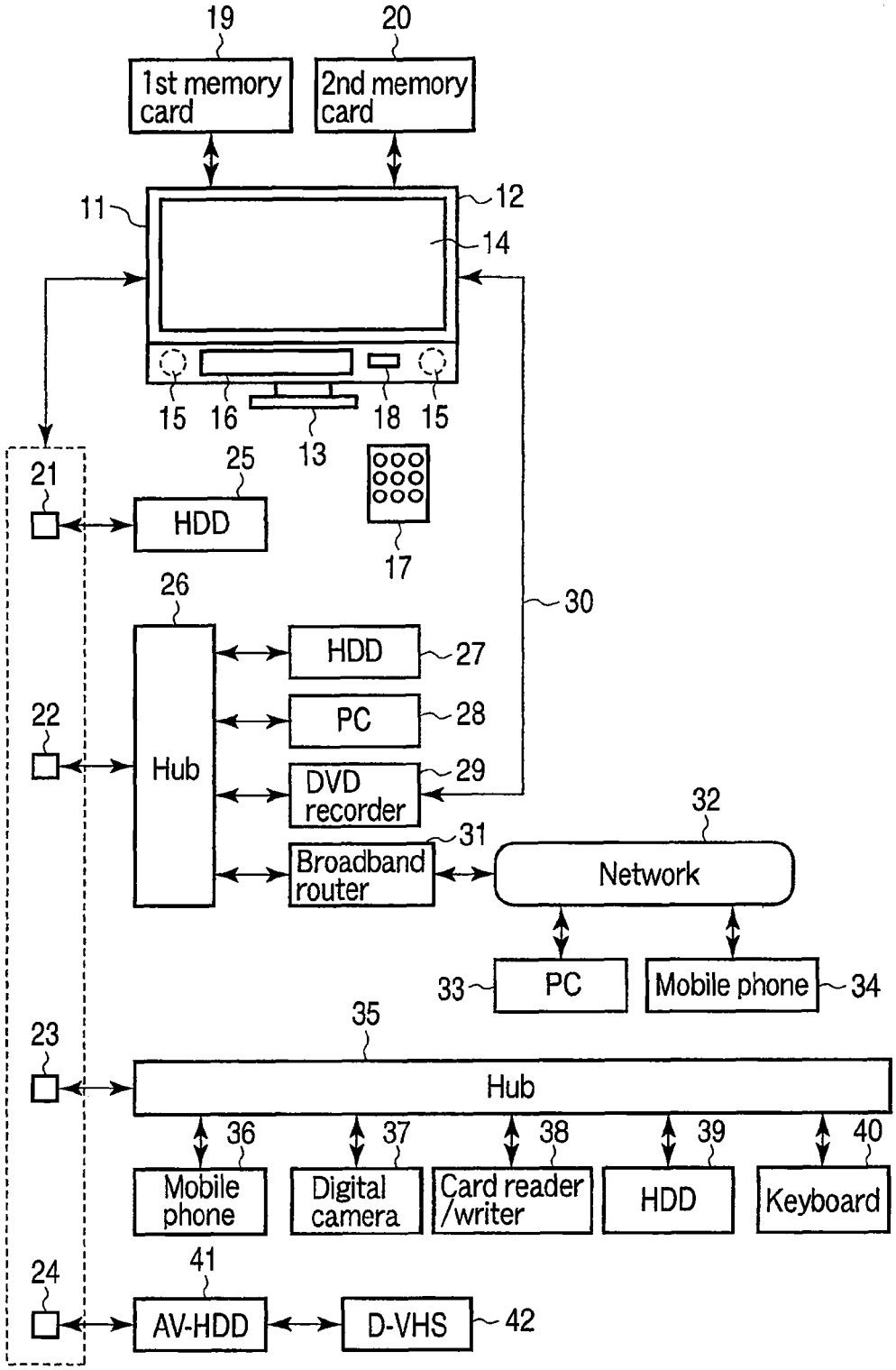
FIG. 1 is a diagram for schematically describing an example of a digital TV broadcast receiver and a network system centered on the receiver according to an embodiment of this invention.

FIG. 1 schematically shows an example of the outer appearance of a digital TV broadcast receiver 11 according to this embodiment and a network system configured of the digital TV broadcast receiver 11 as a main component.

Specifically, the digital TV broadcast receiver 11 is mainly configured of a thin cabinet 12 and a base 13 which erects and supports the cabinet 12 in upright position. The cabinet 12 includes a flat-panel image display 14 such as a surface-conduction electron-emitter display (SED) panel or a liquid crystal display panel, a pair of speakers 15, 15, an operation unit 16, and a photodetector 18 which receives the operation information transmitted from a remote controller 17.

Also, this digital TV broadcast receiver 11 has replaceably mounted thereon, for example, a first memory card 19 such as a Secure Digital (SD) memory card, a Multimedia Card (MMC) or a memory stick in and from which the information such as programs and photos are recorded and reproduced.

Further, this digital TV broadcast receiver 11 has replaceably mounted thereon a second memory card (smartcard, etc.) 20 for recording the contract information, etc., in and from which the information can be recorded and reproduced.

Furthermore, this digital TV broadcast receiver 11 includes a first local area network (LAN) terminal 21, a second LAN terminal 22, a Universal Serial Bus (USB) terminal 23 and an Institute of Electrical and Electronics Engineers (IEEE) 1394 terminal 24.

Among these component parts, the first LAN terminal 21 is used as a port dedicated to a LAN-adapted hard disk drive (HDD) (hereinafter referred to as the LAN-adapted-HDD-dedicated port). Specifically, the first LAN terminal 21 is used to record and reproduce the information, through Ethernet (registered trademark), in and from a LAN-adapted HDD 25 constituting network attached storage (NAS) connected thereto.

As described above, the provision of the first LAN terminal 21 as a LAN-adapted HDD-dedicated port in the digital TV broadcast receiver 11 makes it possible to stably record the information on the broadcast program with a high-definition image quality in the HDD 25 without being affected by the other factors such as the network environments and network operating conditions.

The second LAN terminal 22, on the other hand, is used as an ordinary LAN-adapted port with Ethernet. Specifically, the second LAN terminal 22 is connected to such devices as a LAN-adapted HDD 27, a personal computer (PC) 28 and a Digital Versatile Disk (DVD) recorder 29 including a HDD through a hub 26 to make up a domestic network, for example, and used to transmit the information to and from these devices.

In this case, the PC 28 and the DVD recorder 29 are each configured as a device having the function to operate as a content server in the domestic network and further adapted for universal plug-and-play (UPnP) capable of the service of providing the uniform resource identifier (URI) information required for accessing the contents.

Incidentally, in view of the fact that the digital information supplied by communication through the second LAN terminal 22 is only that for the control system, a dedicated analog transmission path 30 is provided for the DVD recorder 29 to transmit the analog video and audio information to and from the digital TV broadcast receiver 11.

Further, the second LAN terminal 22 is connected to an external network 32 such as an Internet through a broad-band router 31 connected to the hub 26. This second LAN terminal 22 is used also to transmit the information to and from a PC 33 and a mobile phone 34 through the network 32.

Also, the USB terminal 23, which is used as an ordinary USB-adapted port, is connected with and used to transmit the information to and from USB devices such as a mobile phone 36, a digital camera 37, a card reader/writer 38 for the memory card, a HDD 39 and a keyboard 40 through a hub 35.

Further, the IEEE 1394 terminal 24, which is serially connected with plural information recording/reproducing devices such as an AV-HDD 41 and a Digital Video Home System (D-VHS) deck 42, is used to selectively transmit the information to and from each of these devices.

Figure 2:
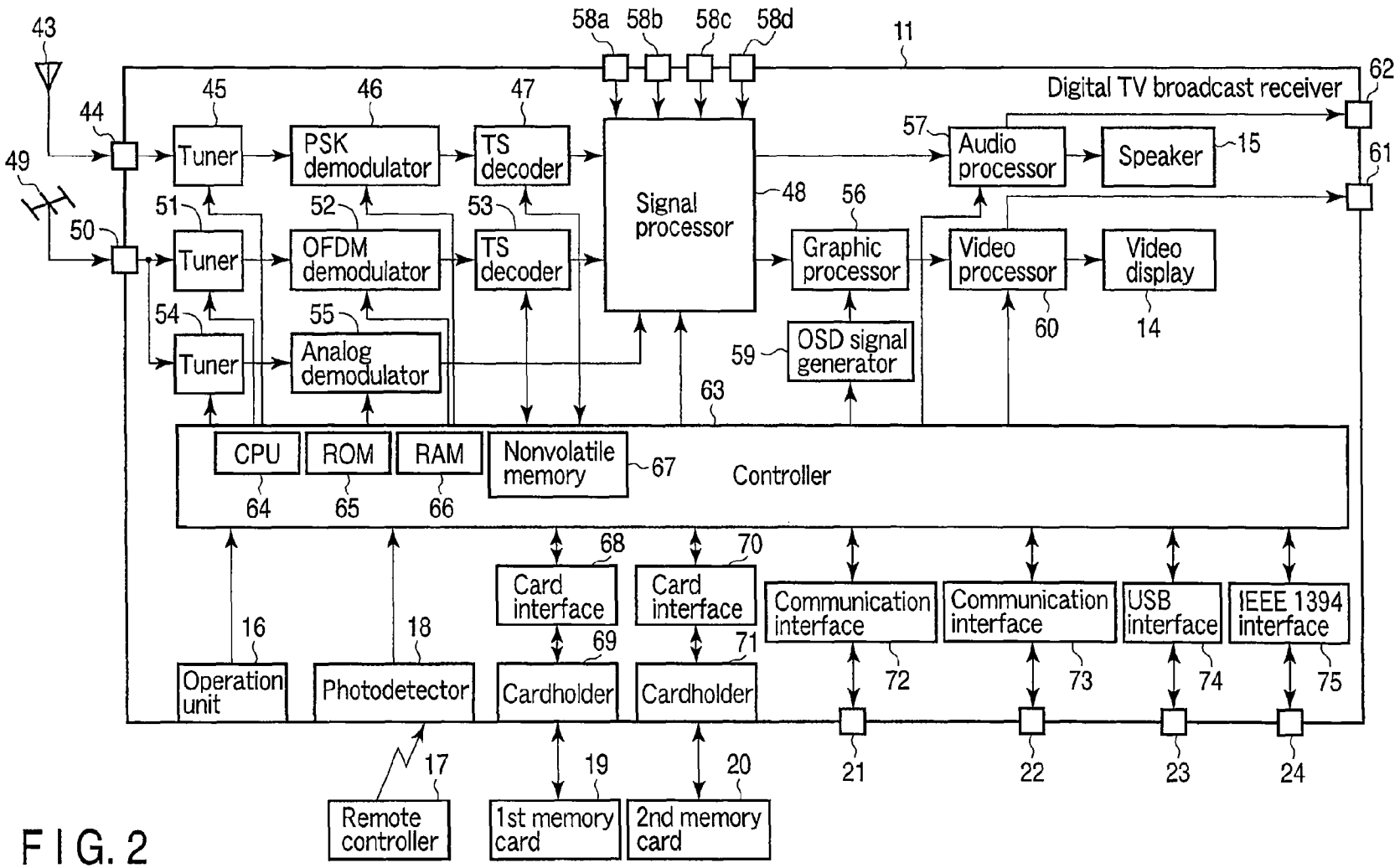
FIG. 2 is a block diagram for describing a main signal processing system of the digital TV broadcast receiver according to the same embodiment.

FIG. 2 shows a main signal processing system of the digital TV broadcast receiver 11. Specifically, the digital satellite TV broadcast signal received through a direct broadcasting by satellite (DBS) digital broadcast receiving antenna 43 is supplied to a satellite digital broadcast tuner 45 through an input terminal 44 thereby to select the broadcast signal of a desired channel.

The broadcast signal selected by the tuner 45 is supplied to a phase shift keying (PSK) demodulator 46 and a transport stream (TS) decoder 47 sequentially, and after being thus demodulated into a digital video signal and a digital audio signal, output to a signal processor 48.

The terrestrial digital TV broadcast signal received through a terrestrial wave broadcast receiving antenna 49, on the other hand, is supplied to a terrestrial digital broadcast tuner 51 through an input terminal 50 thereby to select the broadcast signal of a desired channel.

In Japan, for example, the broadcast signal selected by the tuner 51 is supplied to an orthogonal frequency division multiplexing (OFDM) demodulator 52 and a TS decoder 53 sequentially, and after being demodulated into a digital video signal and a digital audio signal, output to the signal processor 48.

The terrestrial analog TV broadcast signal received through the terrestrial wave broadcast receiving antenna 49 is supplied also to a terrestrial analog broadcast tuner 54 through the input terminal 50 thereby to select the broadcast signal of a desired channel. The broadcast signal selected by the tuner 54 is then supplied to an analog demodulator 55, and after being demodulated into an analog video signal and an analog audio signal, output to the signal processor 48.

The digital video and audio signals supplied from the TS decoders 47, 53 are selectively subjected to a predetermined digital signal processing by the signal processor 48, and then output to a graphic processor 56 and an audio processor 57.

Also, the signal processor 48 is connected with plural (four, in the shown case) input terminals 58*a*, 58*b*, 58*c*, 58*d*, through which an analog video signal and an analog audio signal can be input to the digital TV broadcast receiver 11 from an external source.

The analog video and audio signals supplied from the analog demodulator 55 and the input terminals 58*a* to 58*d*, after being selectively digitized and subjected to a predetermined digital signal processing by the signal processor 48, are output to the graphic processor 56 and the audio processor 57.

The graphic processor 56 has such a function that the digital video signal supplied from the signal processor 48 is output in superposition with the on-screen display (OSD) signal generated by an OSD signal generator 59. The graphic processor 56 can selectively output one of the output video signal of the signal processor 48 and the output OSD signal of the OSD signal generator 59 on the one hand, and can output the two output signals in such a combination that each of the output signals makes up one half of the screen on the other hand.

The digital video signal output from the graphic processor 56 is supplied to a video processor 60. An input digital video signal, after being converting by this video processor 60 into an analog video signal of a format adapted to be displayed on a video display unit 14, is output to and displayed on the video display unit 14, while at the same time being output externally through an output terminal 61.

Also, the audio processor 57, after executing the sound quality correction process described later on the input digital audio signal, converts it into an analog audio signal of a format adapted to be reproduced by the speaker 15. This analog audio signal is output to the speaker 15 for audio reproduction, while at the same time being led out through an output terminal 62.

The entire operations of the digital TV broadcast receiver 11 including the various receiving operations described above are collectively controlled by a controller 63. The controller 63 includes a central processing unit (CPU) 64 which, upon reception of the operation information of the operation unit 16 or the operation information sent out from the remote controller 17 and received by the photodetector 18, controls each part in such a manner as to reflect the operation thereof.

In this case, the controller 63 mainly uses a read-only memory (ROM) 65 which stores a control program executed by the CPU 64, a random access memory (RAM) 66 which provides a working area to the CPU 64, and a nonvolatile memory 67 which stores the various setting information and control information.

Also, the controller 63 is connected, through a card interface 68, to a cardholder 69 with the first memory card 19 mountable thereon. As a result, the controller 63 can transmit and receive the information, through the card interface 68, to and from the first memory card 19 mounted on the cardholder 69.

Further, the controller 63 is connected, through a card interface 70, to a cardholder 71 on which the second memory card 20 can be mounted. As a result, the controller 63 can transmit and receive the information, through the card interface 70, to and from the second memory card 20 mounted on the cardholder 71.

Also, the controller 63 is connected to the first LAN terminal 21 through a communication interface 72. As a result, the controller 63 can transmit and receive the information, through the communication interface 72, to and from the LAN-adapted HDD 25 connected with the first LAN terminal 21. In this case, the controller 63 has a function as a Dynamic Host Configuration Protocol (DHCP) server and performs the control operation by assigning an Internet Protocol (IP) address to the LAN-adapted HDD 25 connected to the first LAN terminal 21.

Further, the controller 63 is connected to the second LAN terminal 22 through a communication interface 73. As a result, the controller 63 can transmit and receive the information, through the communication interface 73, to and from each device (FIG. 1) connected to the second LAN terminal 22.

Also, the controller 63 is connected to the USB terminal 23 through a USB interface 74. As a result, the controller 63 can transmit and receive the information, through the USB interface 74, to and from each device (FIG. 1) connected to the USB terminal 23.

Further, the controller 63 is connected to the IEEE 1394 terminal 24 through an IEEE 1394 interface 75. As a result, the controller 63 can transmit and receive the information, through the IEEE 1394 interface 75, to and from each device (FIG. 1) connected to the IEEE 1394 terminal 24.

Figure 3:
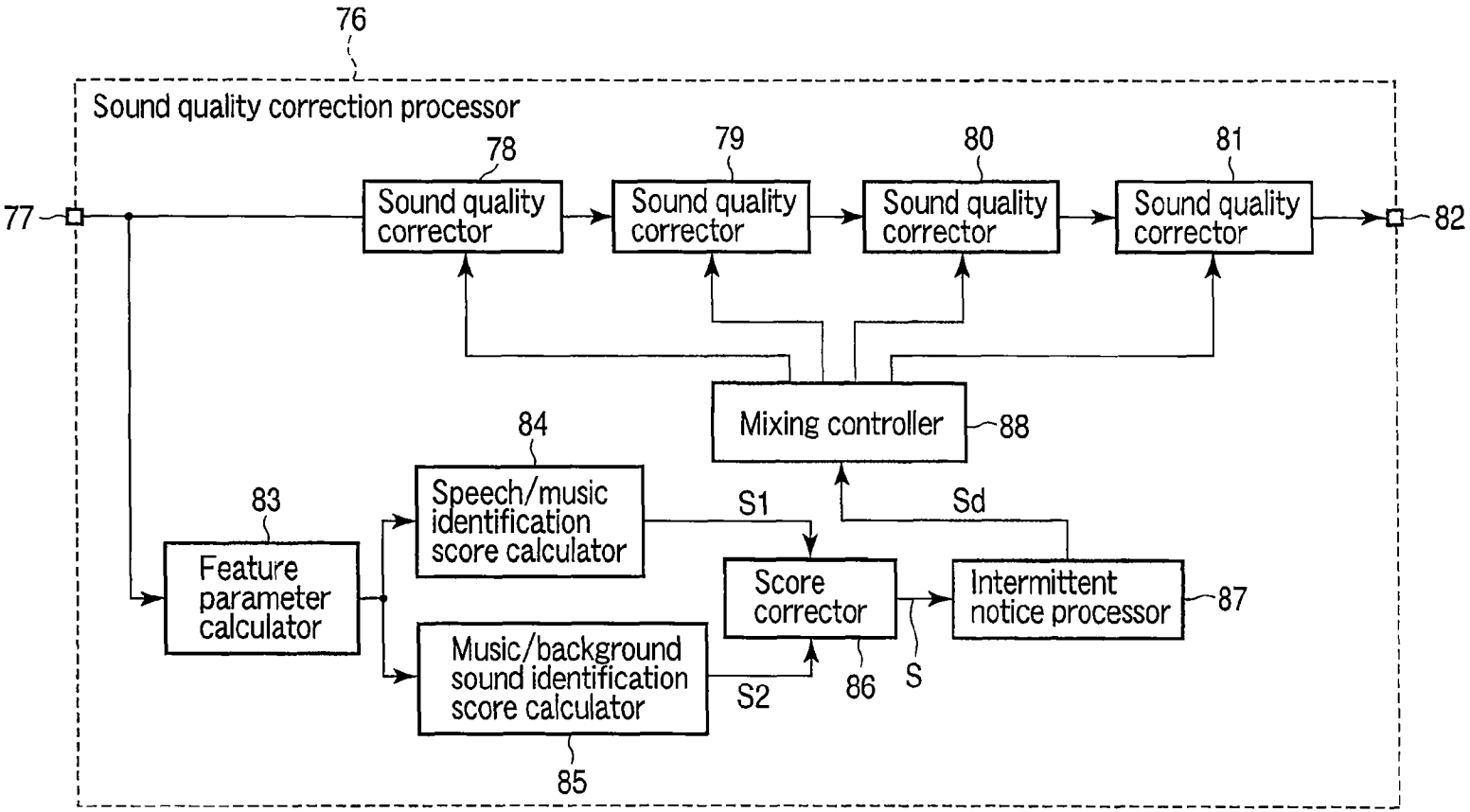
FIG. 3 is a block diagram for describing a sound quality correction processing module included in an audio processor of the digital TV broadcast receiver according to the same embodiment.

FIG. 3 shows a sound quality correction processing module 76 included in the audio processor 57. In the sound quality correction processing module 76, the audio signal supplied to an input terminal 77 is produced from an output terminal 82 after being subjected to different types of sound quality correction processing module by plural (four, in the shown cases) sound quality correctors 78, 79, 80, 81 connected in series.

As an example, the sound quality corrector 78 performs the reverberation process on the input audio signal, the sound quality corrector 79 the wide stereo process on the input audio signal, the sound quality corrector 80 the center emphasis process on the input audio signal, and the sound corrector 81 the process as an equalizer on the input audio signal.

In these sound quality correctors 78 to 81, the strength of the sound quality correction process performed on the input audio signal is controlled independently of each other based on a correction strength control signal generated and output separately for each of the sound quality correctors 78 to 81 by a mixing controller 88 described later.

In the sound quality correction processing module 76, on the other hand, an audio signal is supplied to a feature parameter calculator 83 through an input terminal 77. This feature parameter calculator 83 calculates, from the input audio signal, various feature parameters for identifying the speech signal and the music signal and various feature parameters for identifying the music signal and the background sound signal constituting the background sound such as background music (BGM), hand clapping and shouts.

Figures 4A, 4B:
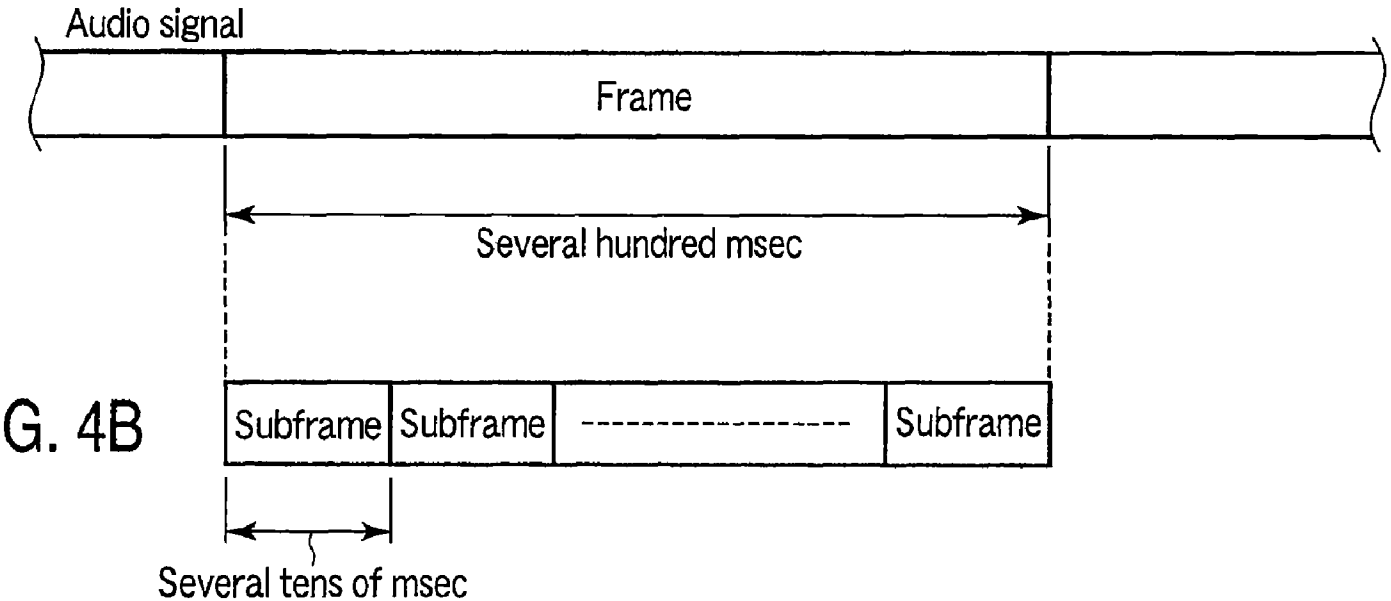
FIGS. 4A and 4B are diagrams for describing the operation of a feature parameter calculator included in the sound quality correction processing module according to the same embodiment.

Specifically, as shown in FIG. 4B, the feature parameter calculator 83 cuts out the input audio signal as subframes each about several tens of milliseconds, and as shown in FIG. 4A, performs the calculation process to construct a frame of about several hundred milliseconds from the subframes cut out.

In this feature parameter calculator 83, various identification information for discriminating the speech signal and the music signal from each other and various identification information for discriminating the music signal and the background sound signal from each other are calculated in units of subframes from the input audio signal. Then, various feature parameters are generated by calculating the statistics (for example, the average, variance, maximum, minimum, etc.) in units of frame for each of the various identification information thus calculated.

For example, in the feature parameter calculator 83, the power value constituting the square sum of the signal amplitude of the input audio signal is calculated as the identification information in units of subframes, and the statistic for the calculated power value is determined in units of frame thereby to generate the feature parameter pw for the power value.

Also, in the feature parameter calculator 83, the zero-cross frequency which is the number of times the temporal waveform of the input audio signal crosses the zero level in the direction of amplitude is calculated as identification information in units of subframes, and the statistic for the calculated zero-cross frequency in units of frame is determined thereby to generate the feature parameter zc for the zero-cross frequency.

Further, in the feature parameter calculator 83, the spectral fluctiations in frequency domain of the input audio signal is calculated as identification information in units of subframes, and the statistic for the calculated spectral fluctiations is determined in units of frame thereby to generate the feature parameter sf for the spectral fluctiations.

Also, in the feature parameter calculator 83, the power ratio (left and right [LR] power ratio) of the two-channel stereo LR signals of the input audio signal is calculated as identification information in units of subframes, and the statistic value for the calculated LR power ratio is determined in units of frame thereby to generate the feature parameter lr for the LR power ratio.

Further, in the feature parameter calculator 83, the degree of concentration of the power component of a specific frequency band characteristic to the instrument sound of a composition is calculated as the identification information in units of subframes after the frequency domain conversion of the input audio signal. This concentration degree is indicated by the power occupancy ratio of the aforementioned characteristically specific frequency band in the entire or specific band of the input audio signal. In the feature parameter calculator 83, the feature parameter inst for the concentration degree of the frequency band characteristic to an instrument sound is generated by determining the statistic for the identification information in units of frame.

Figure 5:
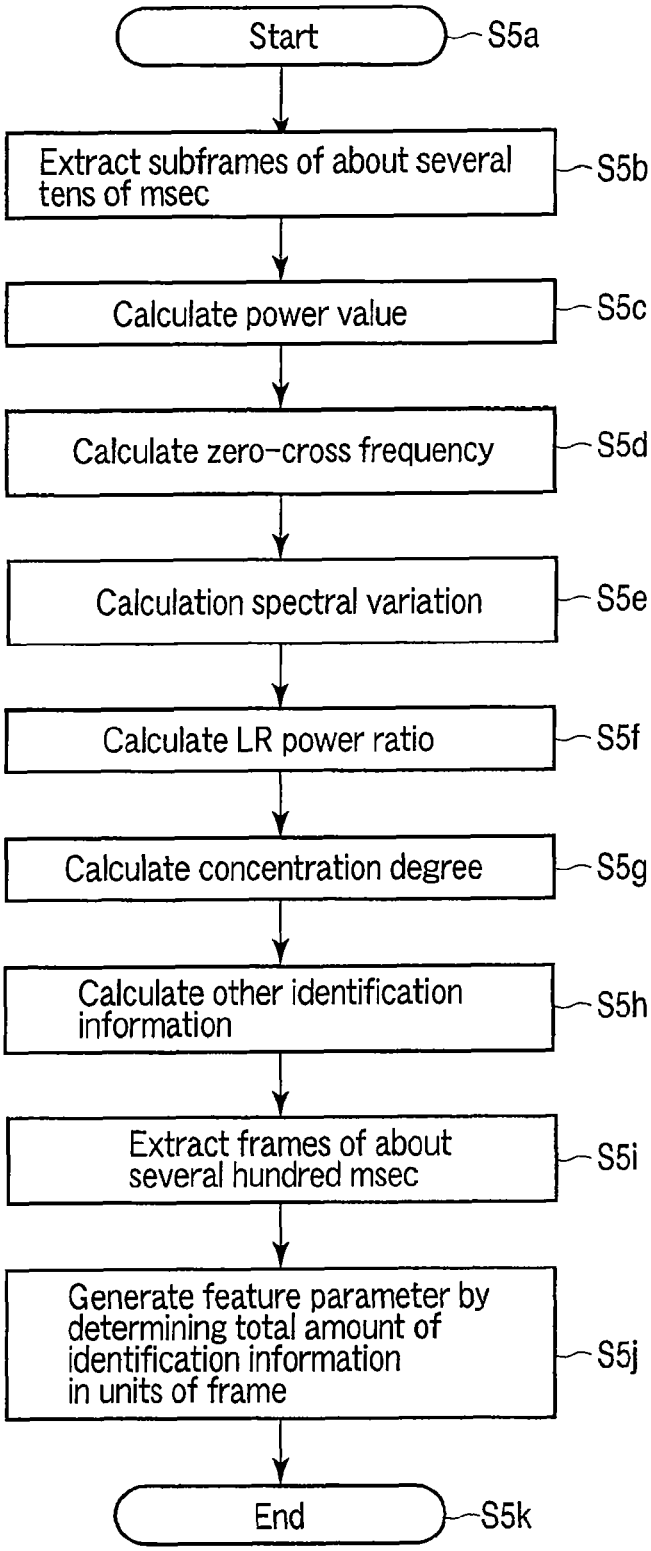
FIG. 5 is a flowchart for describing the processing operation performed by the feature parameter calculator according to the same embodiment.

FIG. 5 shows an example of the flowchart summarizing the processing operation performed by the feature parameter calculator 83 in which the various feature parameters for discriminating the speech signal and the music signal from each other and the various feature parameters for discriminating the music signal and the background sound signal from each other are generated from the input audio signal.

Once the process is started (step S5*a*), the feature parameter calculator 83 extracts subframes of about several tens of milliseconds from the input audio signal in step S5*b*. Then, the feature parameter calculator 83 calculates the power value in units of subframes from the input audio signal in step S5*c*.

After that, the feature parameter calculator 83 calculates the zero-cross frequency in units of subframes from the input audio signal in step S5*d*, the spectral fluctiations in units of subframes from the input audio signal in step S5*e* and the LR power ratio in units of subframes from the input audio signal in step S5*f*.

Also, the feature parameter calculator 83 calculates the concentration degree of the power component of the frequency band characteristic to the instrument sound in units of subframes from the input audio signal in step S5*g*. Similarly, the feature parameter calculator 83 calculates the other identification information in units of subframes from the input audio signal in step S5*h*.

After that, the feature parameter calculator 83 extracts a frame of about several hundred milliseconds from the input audio signal in step S5*i*. Then, in the feature parameter calculator 83, various feature parameters are generated in step S5*j* by determining the statistic in units of frame for the various identification information calculated in units of subframes thereby to end the process (step S5*k*).

As described above, the various feature parameters generated by the feature parameter calculator 83, as shown in FIG. 3, are supplied again to a speech/music identification score calculator 84 and a music/background sound identification score calculator 85.

The speech/music identification score calculator 84, based on the various feature parameters generated by the feature parameter calculator 83, calculates a speech/music identification score S1 quantitatively indicating to which the audio signal supplied to the input terminal 77 is close to, the characteristic of the speech signal such as a speech or the characteristic of the music (composition) signal.

The music/background sound identification score calculator 85, on the other hand, based on the various feature parameters generated by the feature parameter calculator 83, calculates a music/background sound identification score S2 quantitatively indicating to which the audio signal supplied to the input terminal 77 is close to, the characteristic of the music signal or the characteristic of the background sound signal.

The speech/music identification score S1 output from the speech/music identification score calculator 84 and the music/background sound identification score S2 output from the music/background sound identification score calculator 85 are supplied to a score corrector 86. The score corrector 86, as described in detail later, generates a sound type score S by correcting the speech/music identification score S1 based on the music/background sound identification score S2.

Prior to description of the calculation of the speech/music identification score S1 and the music/background sound identification score S2, the properties of the various feature parameters are described. First, the feature parameter pw for the power value is described. Specifically, as far as the power fluctuation is concerned, the speech generally alternates between a speech section and a silence section. Therefore, the difference in signal power is increased between subframes, and the variance of the power value between the subframes tends to increase in terms of subframe. The "power fluctuation" is defined as a feature amount based on the power value change in the frame section longer than the subframe section in which the power value is calculated, and specifically represented by a power variance value.

Also, the feature parameter zc for the zero-cross frequency is described. In addition to the difference between the speech and silence sections described above, the zero-cross frequency of the speech signal is increased for a consonant and decreased for a vowel, and therefore, the variance of the zero-cross frequency between subframes tends to increase in terms of frame.

Further, the feature parameter sf for the spectral fluctiations is described. The frequency characteristic of the speech signal undergoes a greater change in spectral fluctiations than that of the tonal (tonally structured) signal such as the music signal. Therefore, the variance of the spectral fluctiations tends to increase in terms of frame.

Also, the feature parameter lr for the LR power ratio is described. In the music signal, the LR power ratio between the left and right channels tends to increase in view of the fact that the performance of a music instrument other than vocals is often localized at other than the center.

In the speech/music identification score calculator 84 described above, the speech/music identification score S1 is calculated using the feature parameters such as pw, zc, sf and lr which facilitate the discrimination of the signal types of the speech signal and the music signal taking the difference in characteristics between them into consideration.

However, these feature parameters pw, zc, sf and lr, though effective for discriminating the speech signal and the music signal in pure form, cannot always exhibit the same identification effect for such speech signals as hand clapping, shouts, laugh and noises of a large number of persons, which are liable to be determined erroneously as the music signal under the effect of the background sound.

In order to suppress the occurrence of this determination error, the music/background sound identification score calculator 85 calculates the music/background sound identification score S2 quantitatively indicating to which the input audio signal is close to, the characteristic of the music signal or the characteristic of the background sound signal.

The score corrector 86 corrects the speech/music identification score S1 to remove the effect of the background sound using the music/background sound identification score S2. The score corrector 86 thus outputs the sound type score S for suppressing the inconvenience which otherwise might be caused by the speech/music identification score S1 taking on a value close to the music signal than the actual value under the effect of the background sound.

For this purpose, the music/background sound identification score calculator 85 employs the feature parameter inst corresponding to the concentration degree of a specified frequency component of a music instrument as the identification information suitable for discriminating the music signal and the background sound signal from each other.

The feature parameter inst is described. As far as the music signal is concerned, the amplitude power is often concentrated on a specified frequency band in some music instruments to perform a musical composition. In many cases of the modern musical composition, for example, a music instrument constituting a base component is existent, and the analysis of the base sound indicates that the amplitude power is concentrated on a specified low-frequency band of the signal.

In the background sound signal, on the other hand, the power concentration on a specified low-frequency band as described above is not observed. Specifically, in view of the fact that the low-frequency component constituting the base component of the musical composition of the base instrument, the energy concentration degree of the base component can be very effectively used as the identification information for discriminating the musical composition and the background sound. The feature parameter inst described above, therefore, is an effective index for discriminating the music signal and the background sound signal.

Next, an description is given about the calculation of the speech/music identification score S1 and the music/background sound identification score S2 in the speech/music identification score calculator 84 and the music/background sound identification score calculator 85. The calculation of the speech/music identification score S1 and the music/background sound identification score S2 is not limited to one method, and a calculation method using the linear discrimination function is described below.

In the method using the linear discrimination function, a weighting coefficient to be multiplied by various feature parameters required for calculation of the speech/music identification score S1 and the music/background sound identification score S2 is calculated by off-line learning. This weighting coefficient is larger in value, the higher the effectiveness of a feature parameter to identify the signal type.

Also, the weighting coefficient for the speech/music identification score S1 is calculated in such a manner that many known speech and music signals prepared in advance are input as reference data and the feature parameter is learned for the reference data. Similarly, the weighting coefficient for the music/background sound identification score S2 is calculated in such a manner that many known music and background sound signals prepared in advance are input as reference data and the feature parameter is learned for the reference data.

First, the calculation of the speech/music identification score S1 is described. Assume that the feature parameter set of the kth frame of the reference data to be learned is expressed by a vector x, and the signal section {speech, music} associated with the input audio signal is expressed with z as shown below.

$$x^k=(1,x_1^k,x_2^k,\ldots,x_n^k) \tag{1}$$

$$z^k=\{-1,+1\} \tag{2}$$

wherein each element in Equation (1) corresponds to the n feature parameters extracted. Also, "−1" and "+1" in Equation (2) correspond to the speech section and the music section, respectively, which are manually labeled with binary values beforehand for the sections constituting the correct solution signal type of the reference data to be used for speech/music identification. Further, from Equation (2), the following linear discrimination function is set up.

$$f(x)=A_0+A_1\cdot x_1+A_2\cdot x_2+\ldots+A_n\cdot x_n \tag{3}$$

For k=1 to N (N: number of input frames of reference data), the vector x is extracted, and by solving a normal equation minimizing Equation (4) as a sum of squares of the error between the assessment value in Equation (3) and the correct solution signal type in Equation (2), the weighting coefficient $A_i$ (i=0 to n) for each feature parameter is determined.

$$Esum=\sum_{k=1}^{N}(z^k-f(x^k))^2 \tag{4}$$

Using the weighting coefficient determined by learning, the assessment value of the audio signal to be actually identified is calculated from Equation (3), and in the case where f(x)<0, the speech section is determined as involved, while in the case where f(x)>0, the music section is determined as involved. Under this condition, f(x) corresponds to the speech/music identification score S1. Thus, $$S1=A_0+A_1\cdot x_1+A_2\cdot x_2+\ldots+A_n\cdot x_n$$

is calculated.

Similarly, in calculating the music/background sound identification score S2, assume that the feature parameter set of the kth frame of the reference data to be learned is expressed as a vector y, and the signal section {background sound, music} associated with the input audio signal is expressed with z as shown below.

$$y^k=(1,y_1^k,y_2^k,\ldots,y_m^k) \tag{5}$$

$$z^k=\{-1,+1\} \tag{6}$$

Each element in Equation (5) corresponds to the m feature parameters extracted. Also, "−1" and "+1" in Equation (6) correspond to the background sound section and the music section, respectively, and represent a binary value labeled manually beforehand for the section constituting the correct solution signal type of the reference data used for music/background sound identification. Further, from Equation (6), the following linear discrimination function is set up.

$$f(y)=B_0+B_1\cdot y_1+B_2\cdot y_2+\ldots+B_m\cdot y_m \tag{7}$$

For k=1 to N (N: number of input frames of reference data), the vector y is extracted, and by solving a normal equation minimizing Equation (8) as a sum of squares of the error between the assessment value of Equation (7) and the correct solution signal type of Equation (6), the weighting coefficient $B_i$ (i=0 to m) for each feature parameter is determined.

$$Esum=\sum_{k=1}^{N}(z^k-f(y^k))^2 \tag{8}$$

Using the weighting coefficient determined by learning, the assessment value of the audio signal to be actually identified is calculated from Equation (7), and in the case where f(y)<0, the background sound section is determined as involved, while in the case where f(y)>0, the music section is determined as involved. Under this condition, f(y) corresponds to the music/background sound identification score S2. Thus, $$S2=B_0+B_1 \cdot y_1+B_2 \cdot y_2+ \ldots +B_m \cdot y_m$$

is calculated.

Incidentally, the calculation of the speech/music identification score S1 and the music/background sound identification score S2 is not limited to the aforementioned method in which the weighting coefficient determined by off-line learning using the linear discrimination function is multiplied by the feature parameter. As an alternative, a method can also be used in which an experimental threshold value is set for the feature parameter calculation value, and in accordance with the comparative determination with the threshold value, the weighted score is attached to each feature parameter thereby to calculate the score.

Figure 6:
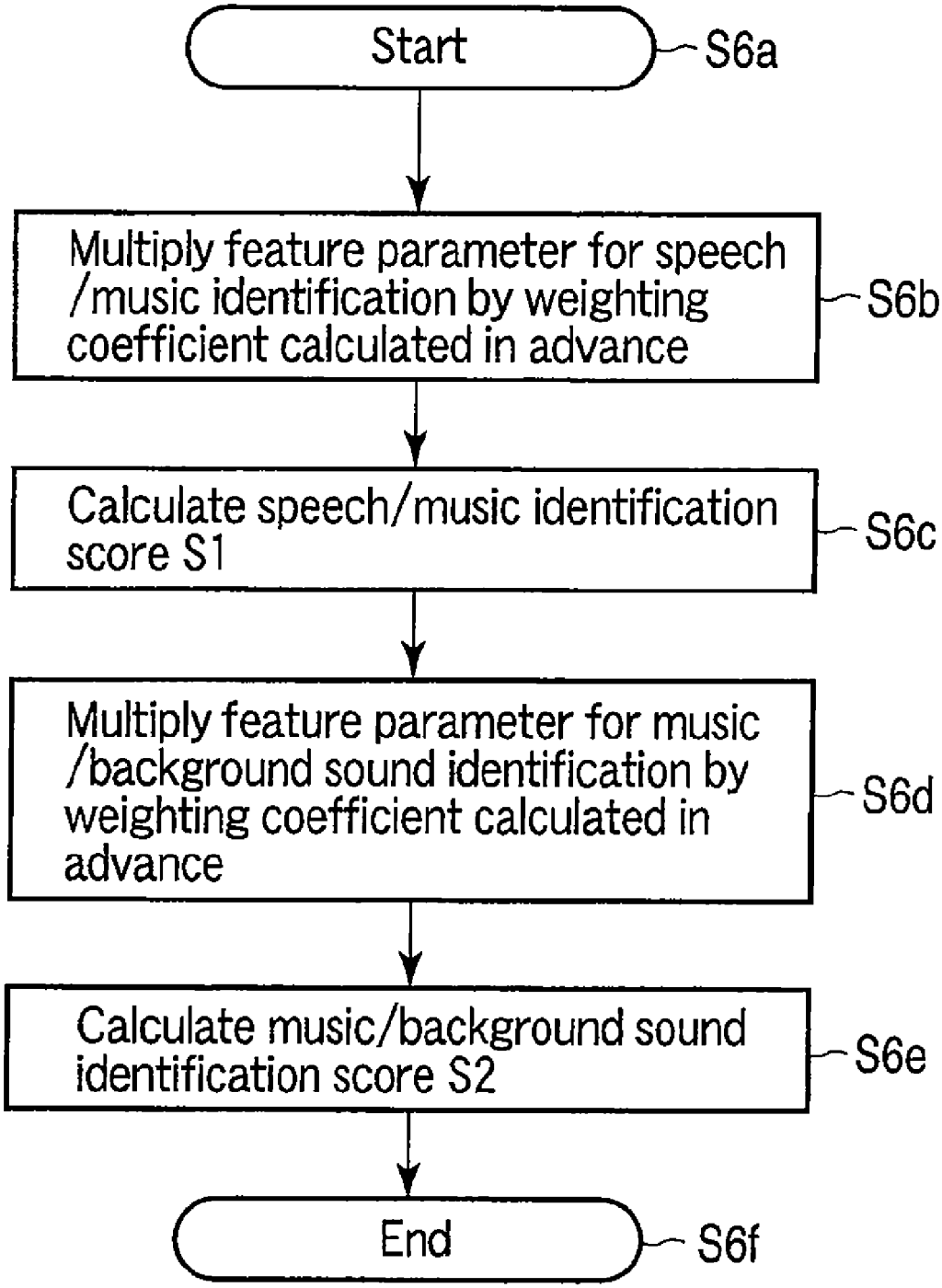
FIG. 6 is a flowchart for describing the operation of calculating the speech/music identification score and the music/background sound identification score performed by the sound quality correction processing module according to the same embodiment.

FIG. 6 shows an example of the flowchart summarizing the processing operation of the speech/music identification score calculator 84 and the music/background sound identification score calculator 85 to calculate the speech/music identification score S1 and the music/background sound identification score S2 based on the weighting coefficient of each feature parameter calculated by off-line learning using the linear discrimination function as described above.

Specifically, once the process is started (step S6*a*), the speech/music identification score calculator 84 assigns, in step S6*b*, the weighting coefficient based on the feature parameter of the reference data for speech/music identification learned in advance, to the various feature parameters calculated by the feature parameter calculator 83, and calculates the feature parameter multiplied by the weighting coefficient. After that, the speech/music identification score calculator 84 calculates, in step S6*c*, the total sum of the feature parameters multiplied by the weighting coefficient as the speech/music identification score S1.

Also, the music/background sound identification score calculator 85 assigns, in step S6*d*, the weighting coefficient based on the feature parameter of the reference data for music/background sound identification learned in advance, to the various feature parameters calculated by the feature parameter calculator 83, and calculates the feature parameters multiplied by the weighting coefficient. After that, the music/background sound identification score calculator 85 calculates, in step S6*e*, the total sum of the feature parameters multiplied by the weighting coefficient as the music/background sound identification score S2, thereby ending the process (step S6*f*).

Figure 7:
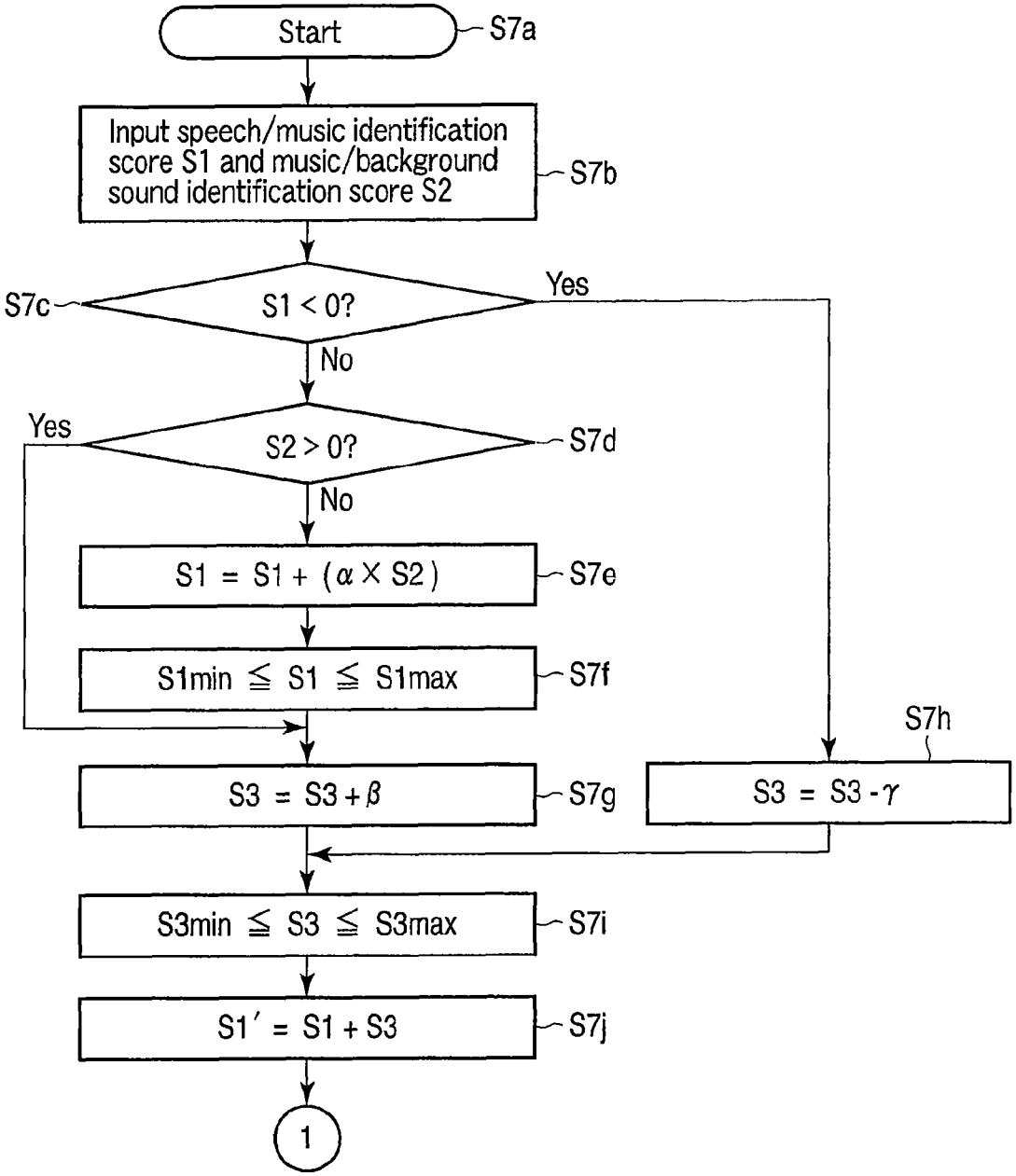
FIG. 7 is a flowchart for describing a part of the score correcting operation performed by the sound quality correction processing module according to the same embodiment.
Figure 8:
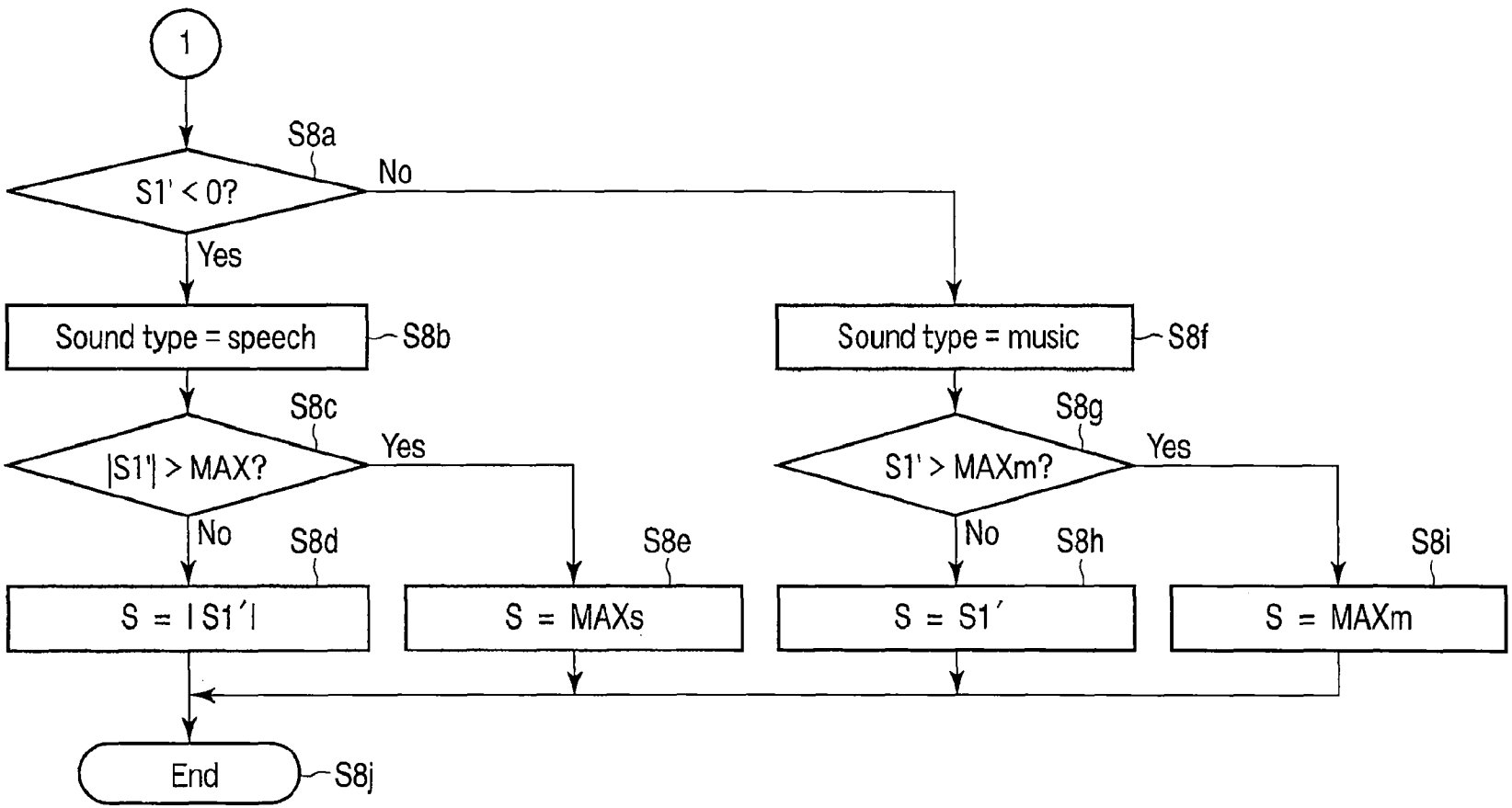
FIG. 8 is a flowchart for describing the remaining part of the score correcting operation performed by the sound quality correction processing module according to the same embodiment.

FIGS. 7 and 8 show an example of the flowchart summarizing the processing operation of the score corrector 86 to correct the speech/music identification score S1 based on the music/background sound identification score S2 and thereby calculate the sound type score S.

Specifically, once the process is started (step S7*a*), the score corrector 86 is supplied, in step S7*b*, with the speech/music identification score S1 and the music/background sound identification score S2 from the speech/music identification score calculator 84 and the music/background sound identification score calculator 85, respectively, and determines, in step S7*c*, whether the speech/music identification score S1 is negative (S1<0) or not, i.e., whether the input audio signal represents a speech or not.

In the case where the speech/music identification score S1 is positive (S1>0), i.e., the input audio signal represents a music (NO), the score corrector 86 determines, in step S7*d*, whether the music/background sound identification score S2 is positive (S2>0) or not, i.e., whether the input audio signal represents a music or not.

Upon determination in step S7*d* that the music/background sound identification score S2 is negative (S2<0), i.e., the input audio signal represents a background sound (NO), the score corrector 86 corrects the speech/music identification score S1 to remove the effect of the background sound using the music/background sound identification score S2.

As the first step of this correction process, the product of the music/background sound identification score S2 and a predetermined coefficient a is added to the speech/music identification score S1 in order to subtract the portion contributive to the background sound from the speech/music identification score S1, i.e., to hold the relation S1=S1+(α× S2), in step S7*e*. In this case, the music/background sound identification score S2 is negative, and therefore, the speech/music identification score S1 is reduced in value.

After that, in order to prevent the speech/music identification score S1 from being excessively corrected in step S7*e*, the clip process is executed in step S7*f* so that the speech/music identification score S1 computed erroneously in step S7*e* takes on a value in a preset range between a minimum value S1min and a maximum value S1max, i.e., so that the relation holds that S1min≦S1≦S1max.

After step S7*f* or upon determination in step S7*d* that the music/background sound identification score S2 is positive (S2>0), i.e., that the music/background sound identification score S2 represents a music (YES), then the score corrector 86 generates a stabilization parameter S3 to improve the effect of the music sound quality correction process by the sound quality correctors 78 to 81 in step S7*g*.

In this case, the stabilization parameter S3 functions to both stabilize and improve the correction strength for the speech/music identification score S1 which determines the strength of the correction process performed by the sound quality correctors 78 to 81. This is in order to prevent the speech/music identification score S1 from failing to increase in value for some music scene and a sufficient sound quality correction effect from being produced for the music signal.

Specifically, in step S7*g*, the stabilization parameter S3 is generated by adding a predetermined value β accumulatively each time a frame with the speech/music identification score S1 determined as positive is detected successively at least a predetermined number Cm of times in such a manner as to strengthen the sound quality correction process more, the longer the time when the speech/music identification score S1 remains positive, i.e., the longer the continuous time of determination that the speech/music identification score S1 represents the music signal.

Also, the value of the stabilization parameter S3 is held over frames, and therefore, continues to be updated even in the case where the input audio signal is switched to the speech. Specifically, in the case where step S7*c* determines that the speech/music identification score S1 is negative (S1<0), i.e., the input audio signal represents a speech (YES), the score corrector 86 subtracts, in step S7*h*, a predetermined value γ from the stabilization parameter S3 each time the frame with the speech/music identification score S1 determined as negative is detected at least the preset number Cs of times successively in such a manner as to reduce the effect of the music sound quality correction process in the sound quality correctors 78 to 81 more, the longer the time when the speech/music identification score S1 remains negative, i.e., the longer the time continues when the speech/music identification score S1 is determined as indicative of the speech signal.

After that, in order to prevent the excessive correction by the stabilization parameter S3 generated in step S7*g* or S7*h*, the score corrector 86 performs the clip process in step S7*i* so that the stabilization parameter S3 may be included in the range between the minimum value S3min and the maximum value S3max as predetermined, i.e., so that the relation may hold that S3min≦S3<S3max.

Then, in step S7*j*, the score corrector 86 adds the stabilization parameter S3 clipped in step S7*i*, to the speech/music identification score S1 clipped in step S7*f* thereby to generate a correction score S1'.

After that, the score corrector 86 determines in step S8*a* whether the correction score S1' is negative (S1'<0) or not, and upon determination that it is negative (YES), determines in step S8*b* that the sound type score S of the input audio signal is a speech.

The score corrector 86, in step S8*c*, acquires the absolute value of the negative correction score S1', and determines whether or not the absolute value |S1'| of the correction score is larger than a preset maximum value MAXs for the speech.

In the case where the absolute value |S1'| of the correction score is determined not larger than the preset maximum value MAXs (NO) in step S8*c*, the score corrector 86 outputs the absolute value |S1'| of the correction score as a sound type score S in step S8*d* and ends the process (step S8*j*).

In the case where step S8*c* determines that the absolute value |S1'| of the correction score is larger than the maximum value MAXs (YES), on the other hand, the score corrector 86 outputs the maximum value MAXs as the sound type score S in step S8*e* and ends the process (step S8*j*).

Assume that step S8*a* determines the correction score S1' as positive (NO). The score corrector 86 determines in step S8*f* that the sound type of the input audio signal is music.

Then, the score corrector 86 determines in step S8*g* whether or not the correction score S1' is larger than a maximum value MAXm preset for the music. Upon determination that the correction score S1' is not larger than the maximum value MAXm (NO), the score corrector 86 outputs the correction score S1' as a sound type score S in step S8*h* thereby to end the process (step S8*j*).

Upon determination in step S8*g* that the correction score S1' is larger than the maximum value MAXm (YES), on the other hand, the score corrector 86 outputs the maximum value MAXm as the sound type score S in step S8*i* and ends the process (step S8*j*).

The sound type score S output from the score corrector 86 as described above, as shown in FIG. 3, is supplied again to an intermittent notice processing module 87. In the intermittent notice processing module 87, the sound type score S calculated for each analysis section of several tens of milliseconds is smoothed or weighted for use in the sound quality correction process performed by the sound quality correctors 78 to 81 at intervals of about 1 sec, and notified to the mixing controller 88 as an intermittent score Sd.

In this way, the intermittent score Sd having a longer period than the sound type score S is generated from the sound type score S, and supplied to the mixing controller 88 for use in the sound quality correction process performed by the sound quality correctors 78 to 81. As a result, the communication load between the identification processing system for the speech/music/background sound and the sound quality correction processing system, which may be packaged separately from each other depending on the hardware or software configuration, can be reduced.

Figure 9:
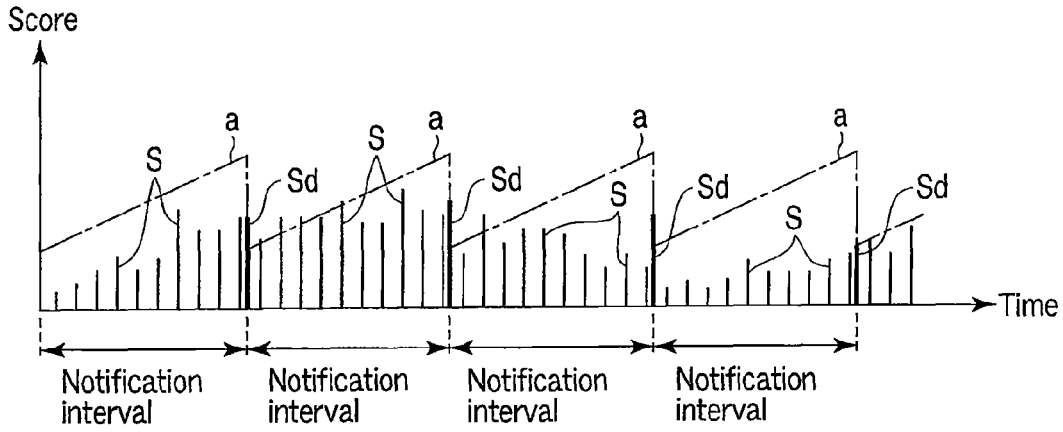
FIG. 9 is a diagram for describing a method of generating an intermittent score executed by the sound quality correction processing module according to the same embodiment.

FIG. 9 shows the correspondence between the sound type score S and the intermittent score Sd. Methods conceived to smooth the sound type score S include a method which utilizes the average value of plural scores by sound type S(n) existing within the notification interval and a calculation method in which the weighting coefficient a(n) emphasizing the value of the sound type score S(n) near to the notification time is multiplied by the sound type score S(n) as shown in the equation below.

$$Sd=a(n)\cdot Sd(n)+a(n-1)\cdot Sd(n-1)+a(n-2)\cdot Sd(n-2)+\ldots$$

where n is the discretion time with the interval of calculation of the sound type score S as a unit, and the weighting coefficient a holds the relation a(n−1)<a(n)≦1.0.

Figure 10:
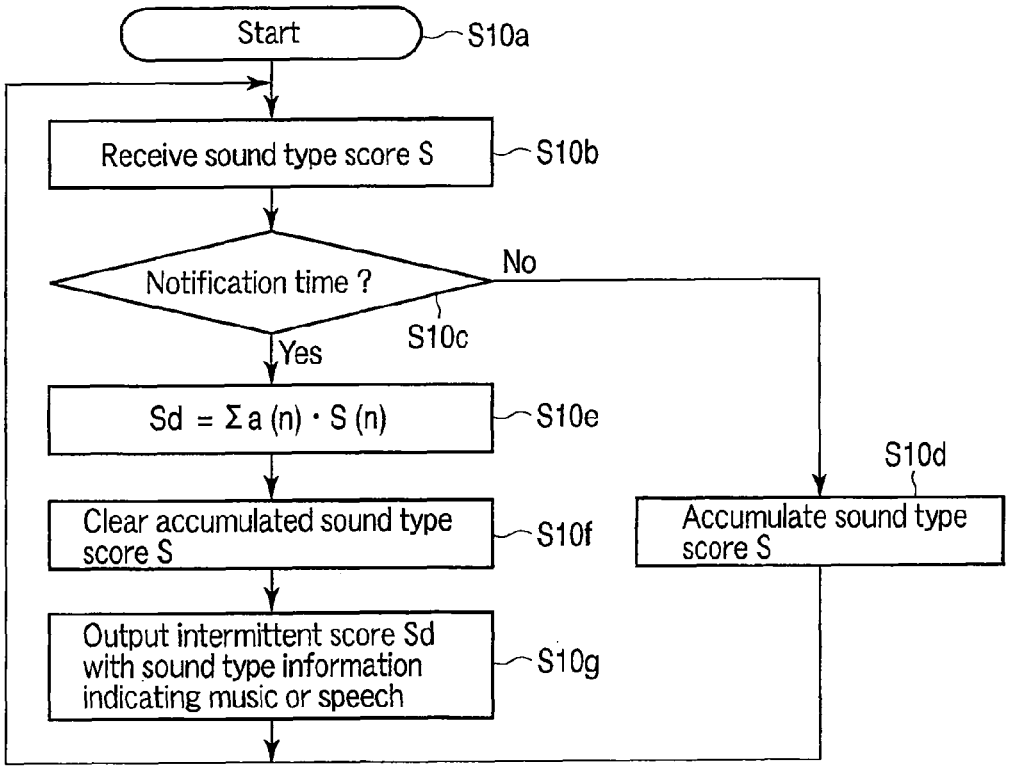
FIG. 10 is a flowchart for describing an example of the operation performed by the sound quality correction processing module to generate an intermittent score according to the same embodiment.

FIG. 10 is a flowchart summarizing an example of the processing operation of the intermittent notice processing module 87 to generate the intermittent score Sd from the sound type score S. Specifically, once the process is started (step S10*a*), the intermittent notice processing module 87 receives the sound type score S from the score corrector 86 in step S10*b*.

After that, the intermittent notice processing module 87 determines in step S10*c* whether the period has arrived to notify the intermittent score Sd to the mixing controller 88, and upon determination that the notification time has yet to arrive (NO), executes step S10*d* in which the sound type score S received from the score corrector 86 is accumulated, for example, in the nonvolatile memory 67, and the process returns to step S10*b*.

Upon determination in step S10*c* that the notification time has arrived (YES), on the other hand, the intermittent notice processing module 87 calculates the intermittent score Sd from the accumulated sound type score S(n) and the weighting coefficient a(n) in step S10*e*.

After that, the intermittent notice processing module 87, in step S10*f*, clears the sound type score S accumulated in the nonvolatile memory 67. In step S10*g*, the sound type information indicating whether the intermittent score Sd calculated in step S10*e* represents a music or a speech is attached to the intermittent score Sd, and transmitted to the mixing controller 88, followed by returning the process to step S10*b*.

Figure 11:
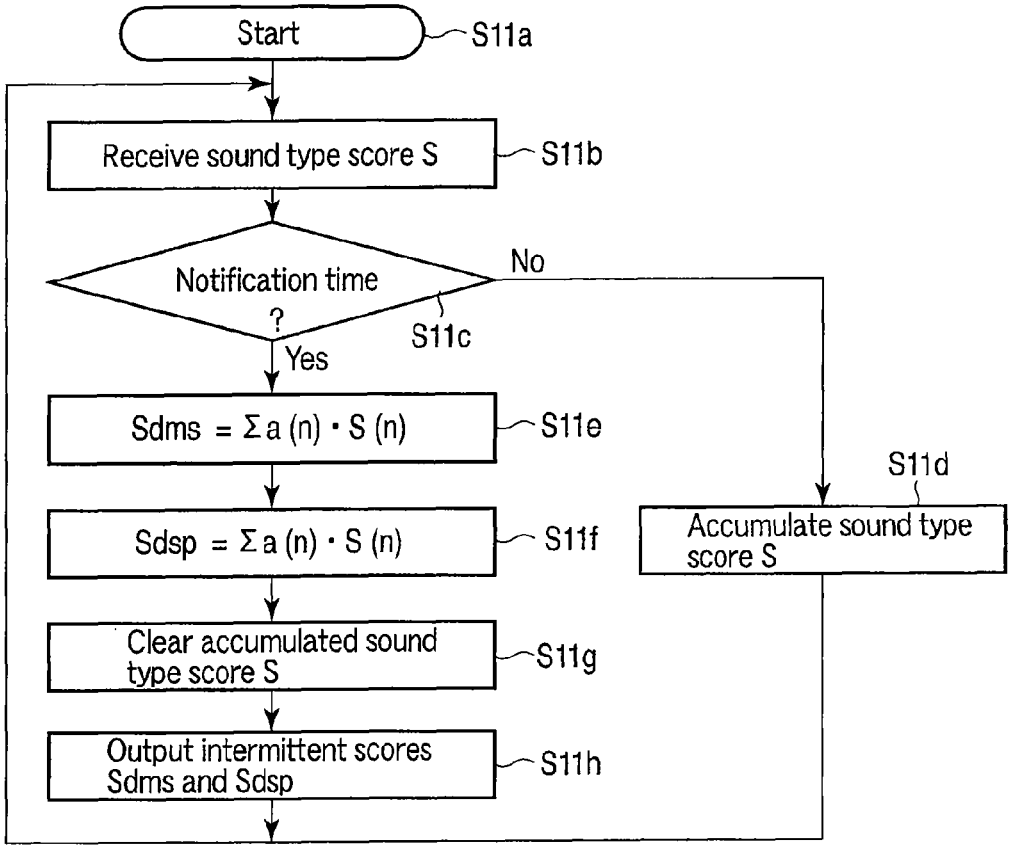
FIG. 11 is a flowchart for describing another example of the operation performed by the sound quality correction processing module to generate an intermittent score according to the same embodiment.

FIG. 11 is a flowchart summarizing another example of the processing operation of the intermittent notice processing module 87 to generate the intermittent score Sd from the sound type score S. Specifically, once the process is started (step S11*a*), the intermittent notice processing module 87 receives, in step S11*b*, the sound type score S from the score corrector 86.

After that, the intermittent notice processing module 87 determines in step S11*c* whether the period has arrived to notify the intermittent score Sd to the mixing controller 88 or not, and upon determination that the notification time has yet to arrive (NO), the sound type score S received from the score corrector 86 is accumulated in the nonvolatile memory 67, etc., in step S11*d*, and the process returns to step S11*b*.

Upon determination in step S11*c* that the notification time has arrived (YES), on the other hand, the intermittent notice processing module 87, in step S11*e*, calculates the intermittent score Sdms for music from the accumulated sound type score S(n) and the weighting coefficient a(n). In this case, only the value of the music as the sound type is used for the intermittent score Sdms for music.

Further, the intermittent notice processing module 87 calculates the intermittent score Sdsp for speech, in step S11*f*, from the accumulated sound type score S(n) and the weighting coefficient a(n). Also in this case, only the value of the speech as the sound type is used for the intermittent score Sdsp for speech.

After that, in step S11*g*, the intermittent notice processing module 87 clears the sound type score S accumulated in the nonvolatile memory 67, and in step S11*h*, transmits the intermittent scores Sdms and Sdsp for music and speech calculated in steps S11*e* and S11*f*, respectively, to the mixing controller 88, followed by returning the process to step S11*b*.

Figure 12:
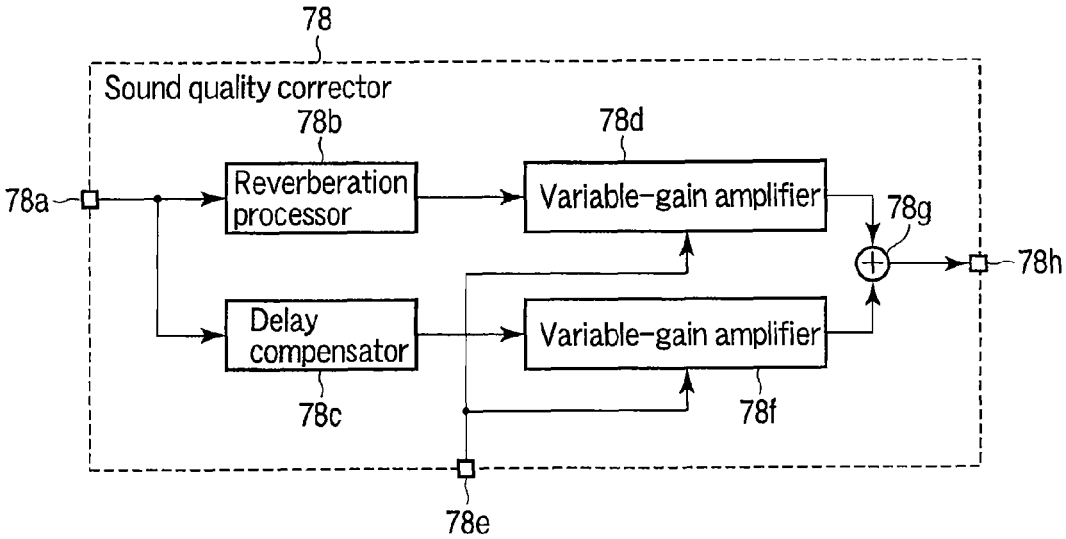
FIG. 12 is a block diagram for describing an example of a sound quality corrector included in the sound quality correction processing module according to the same embodiment.

Next, FIG. 12 shows an example of the sound quality corrector 78 among the sound quality correctors 78 to 81. Incidentally, the other sound quality corrector 79 to 81, which are configured and operate substantially the same way as the sound quality corrector 78, are not described.

Specifically, in the sound quality corrector 78, the audio signal supplied to an input terminal 78*a* is supplied to a reverberation processing module 78*b* and a delay compensator 78*c*. The reverberation processing module 78*b* executes the reverberation process to add the echo effect to the input audio signal, and then outputs the resulting signal to a variable-gain amplifier 78*d*.

The variable-gain amplifier 78*d* amplifies the input audio signal with a gain G based on a correction strength control signal output from the mixing controller 88 and supplied through an input terminal 78*e*. In this case, the gain G of the variable-gain amplifier 78*d* is varied in the range of 0.0 to 1.0 based on the correction strength control signal.

Also, the delay compensator 78*c* is provided to absorb the processing delay between the input audio signal and the audio signal obtained from the reverberation processing module 78*b*. The audio signal output from the delay compensator 78*d* is supplied to a variable-gain amplifier 78*f*.

The variable-gain amplifier 78*f* amplifies the input audio signal with a gain of 1.0 less the gain G of the variable-gain amplifier 78*d*. The audio signals output from the variable-gain amplifiers 78*d*, 78*f* are added in an adder 78*g* and produced from an output terminal 78*h*.

Incidentally, the other sound quality correctors 79 to 81 are so configured that the reverberation processing module 78*b* of the sound quality corrector 78 is replaced by a wide stereo processing module, a center emphasis processing module, an equalization processing module, etc.

FIG. 13 shows a table for setting the strength of sound quality correction operation by the sound quality correctors 78 to 81 based on the input intermittent score Sd by the mixing controller 88. In this correction strength setting table, the sound type, the gain G set in the variable-gain amplifier 78*d* associated with the maximum value of the intermittent score Sd, the gain G set in the variable-gain amplifier 78*d* associated with the minimum value of the intermittent score Sd, the forward transition time for controlling the sound quality correction in the direction toward a higher strength and the backward transition time for controlling the sound quality correction in the direction toward a lower strength are defined by the type of sound quality correction (reverberation, wide stereo, center emphasis and equalization).

Consider the reverberation process in the sound quality corrector 78, for example. In the case where the sound type is a music with the intermittent score Sd at a maximum or the intermittent score Sdms based on the calculation method shown in FIG. 11 is at a maximum value, then the mixing controller 88 outputs a correction strength control signal to the sound quality corrector 78 in order to set the gain G of the variable-gain amplifier 78*d* to 1.0 and the gain of the variable-gain amplifier 78*f* on the original sound side to 0.0 (=1.0−G) in such a manner as to output only the audio signal of the reverberation processing module 78*b* from an output terminal 78*h*, thereby increasing the sound quality correction strength for the reverberation process to the highest level.

In the case where the sound type is a music with the intermittent score Sd at a minimum, the sound type is a speech or the intermittent score Sdms based on the calculation method shown in FIG. 11 is at a minimum, on the other hand, the mixing controller 88 operates in such a manner that the gain G of the variable-gain amplifier 78*d* for amplifying the audio signal output from the reverberation processing module 78*b* is set to 0.0 and the gain of the variable-gain amplifier 78*f* on the original sound side to 1.0 (=1.0−G), thereby decreasing the sound quality correction strength for the reverberation process to the lowest level.

Also, consider the center emphasizing process in the sound quality corrector 78. In the case where the sound type is a speech with the intermittent score Sd at a maximum or the intermittent score Sdsp based on the calculation method shown in FIG. 11 is at a maximum, then the mixing controller 88 outputs a correction strength control signal to the sound quality corrector 80 in order to set the gain G of a variable-gain amplifier (located at the position of, for example, the variable-gain amplifier 78*d* of the sound quality corrector 78) to 1.0 and the gain of a variable-gain amplifier (located at the position of, for example, the variable-gain amplifier 78*f* of the sound quality corrector 78) on the original sound side to 0.0 (=1.0−G) in such a manner as to output only the audio signal of a center emphasis processing module (located at the position of, for example, the reverberation processing module 78*b* of the sound quality corrector 78) from an output terminal, thereby increasing the sound quality correction strength for the center emphasis process to the highest level.

In the case where the sound type is a speech with the intermittent score Sd at a minimum, the sound type is a music or the intermittent score Sdsp based on the calculation method shown in FIG. 11 is at a minimum, on the other hand, the mixing controller 88 operates in such a manner that the gain G of a variable-gain amplifier for amplifying the audio signal output from the center emphasis processing module is set to 0.0 and the gain of a variable-gain amplifier on the original sound side to 1.0 (=1.0−G), thereby decreasing the sound quality correction strength for the center emphasis process to the lowest level.

Also, consider a case in which the strength of sound quality correction for reverberation is progressively increased. The mixing controller 88 outputs a correction strength control signal to the sound quality corrector 78 to strengthen the correction by a predetermined amount for each forward transition time T1*f*sec. Similarly, in the case where the strength of sound quality correction for reverberation is progressively decreased, the mixing controller 88 outputs a correction strength control signal to the sound quality corrector 78 to weaken the correction by a predetermined amount for each backward transition time T1*b*sec.

As described above, the provision of a different transition time for each of the cases in which the sound quality correction is strengthened and weakened according to the type thereof can reduce the subjective sense of incongruence of the correction which otherwise might be caused by an erroneous determination for a musical composition (determination as a music) or a talk (determination as a speech).

This subjective effect of the erroneous determination varies depending on the type of sound quality correction. The correction strength for the equalizer, for example, has a large effect if weakened suddenly during the performance of musical composition. The erroneous determination during a talk, on the other hand, has not a very large effect, and therefore, the effect of the erroneous determination can be relaxed while at the same time maintaining a high correction effect by reducing the forward transition time and increasing the backward transition time.

Also, the correction by reverberation for a music has a large effect on the erroneous determination in a talk, and therefore, this effect can be relaxed by reducing the backward transition time while at the same time increasing the forward transition time.

Figure 14:
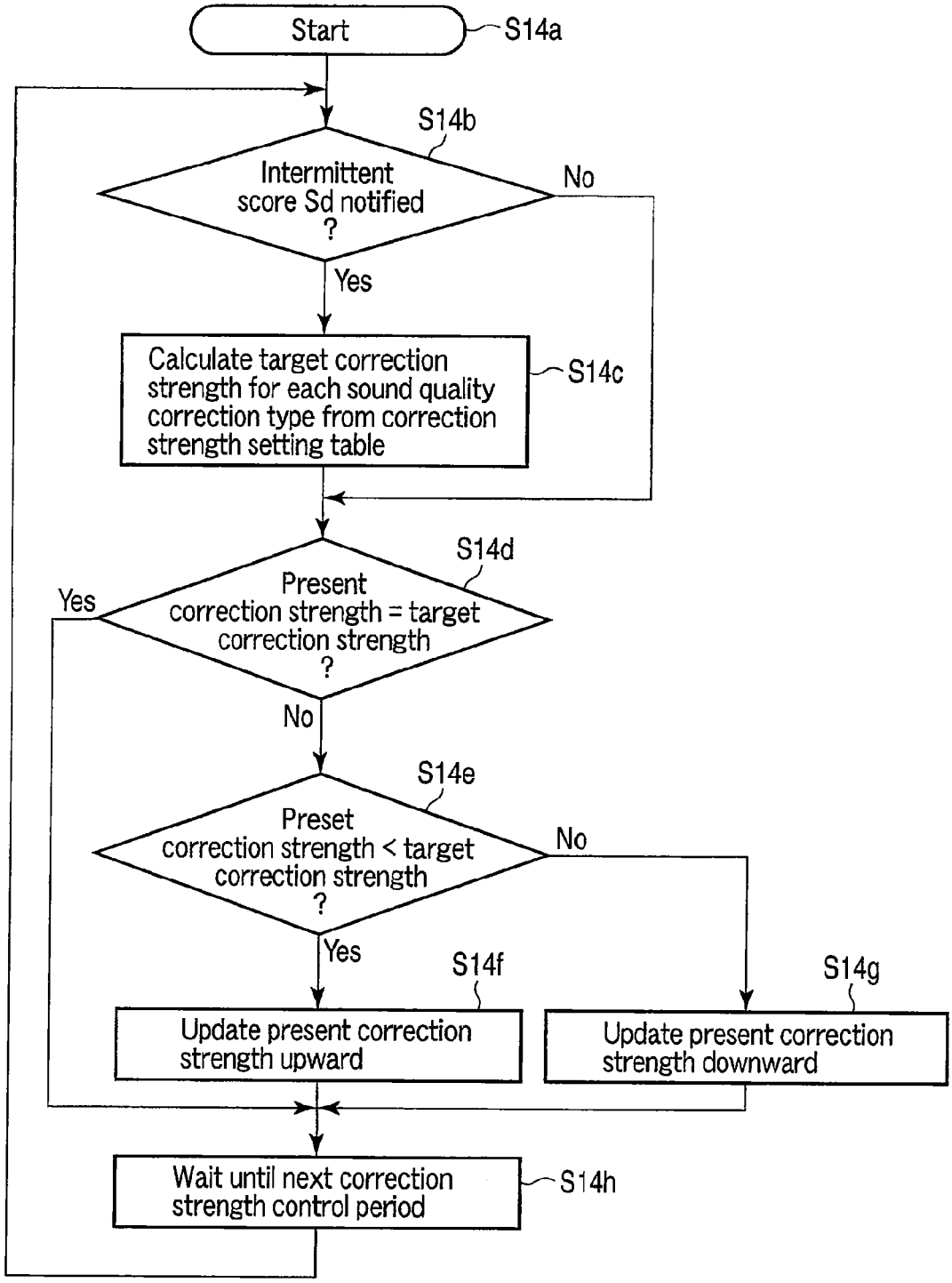
FIG. 14 is a flowchart for describing the processing operation performed by the sound quality correction processing module to change the sound quality correction strength based on the table according to the same embodiment.

FIG. 14 is a flowchart summarizing the processing operation for controlling the sound quality correction strength based on the input intermittent score Sd or the intermittent score Sdms or Sdsp corresponding to the sound type shown in FIG. 13 (all the scores Sd, Sdm and Sdsp are hereinafter referred to collectively as the intermittent score Sd). Specifically, once the process is started (step S14*a*), the mixing controller 88 determines in step S14*b* whether the intermittent score Sd is notified or not.

Upon determination that the intermittent score Sd is notified (YES), the mixing controller 88 calculates a target correction strength for each type of sound quality correction in step S14*c* by referring to the correction strength setting table based on the notified intermittent score Sd.

After step S14*c* or upon determination in step S14*b* that the intermittent score Sd is not notified (NO), the mixing controller 88 determines in step S14*d* whether or not the present correction strength coincides with the target correction strength (calculated by the last notified intermittent score Sd in the case where the answer is NO in step S14*b*).

Upon determination that the present correction strength fails to coincide with the target correction strength (NO), the mixing controller 88 determines in step S14*e* whether the present correction strength is lower than the target correction strength or not. Upon determination that the present correction strength is lower than the target correction strength (YES), the correction strength is required to be increased, and therefore, the mixing controller 88, in step S14*f*, updates the present correction strength upward in units of the step width calculated by the equation below based on the forward transition time in the correction strength correspondence table. Incidentally, this upward updating of the present correction strength in step S14*f* is carried out for each of a preset control period (say, several tens of milliseconds).

Upon determination in step S14*e* that the present correction strength is higher than the target correction strength (NO), on the other hand, the correction strength is required to be decreased, and therefore, the mixing controller 88, in step S14*g*, updates the present correction strength downward in units of the step width calculated by the equation below based on the backward transition time in the correction strength correspondence table. Incidentally, this downward updating of the present correction strength in step S14*g* is also carried out for each of a preset control period (say, several tens of milliseconds).

After step S14*f* or S14*g* or upon determination in step S14*d* that the present correction strength coincides with the target correction strength (YES), then the mixing controller 88 waits in step S14*h* until the next correction strength control period arrives, after which the process is returned to step S14*b*.

The step width Gstep for updating the correction strength is expressed as $$Gstep=(Gmax-Gmin)\cdot Tcnt/Ttrans$$

where Gmax is the correction strength corresponding to the maximum value of the intermittent score Sd (decimal "255" for 8 bits of the intermittent score Sd), Gmin the correction strength corresponding to the minimum value of the intermittent score Sd (decimal "0" for 8 bits of the intermittent score Sd), Tcnt the control period and Ttrans the transition time.

Figure 15:
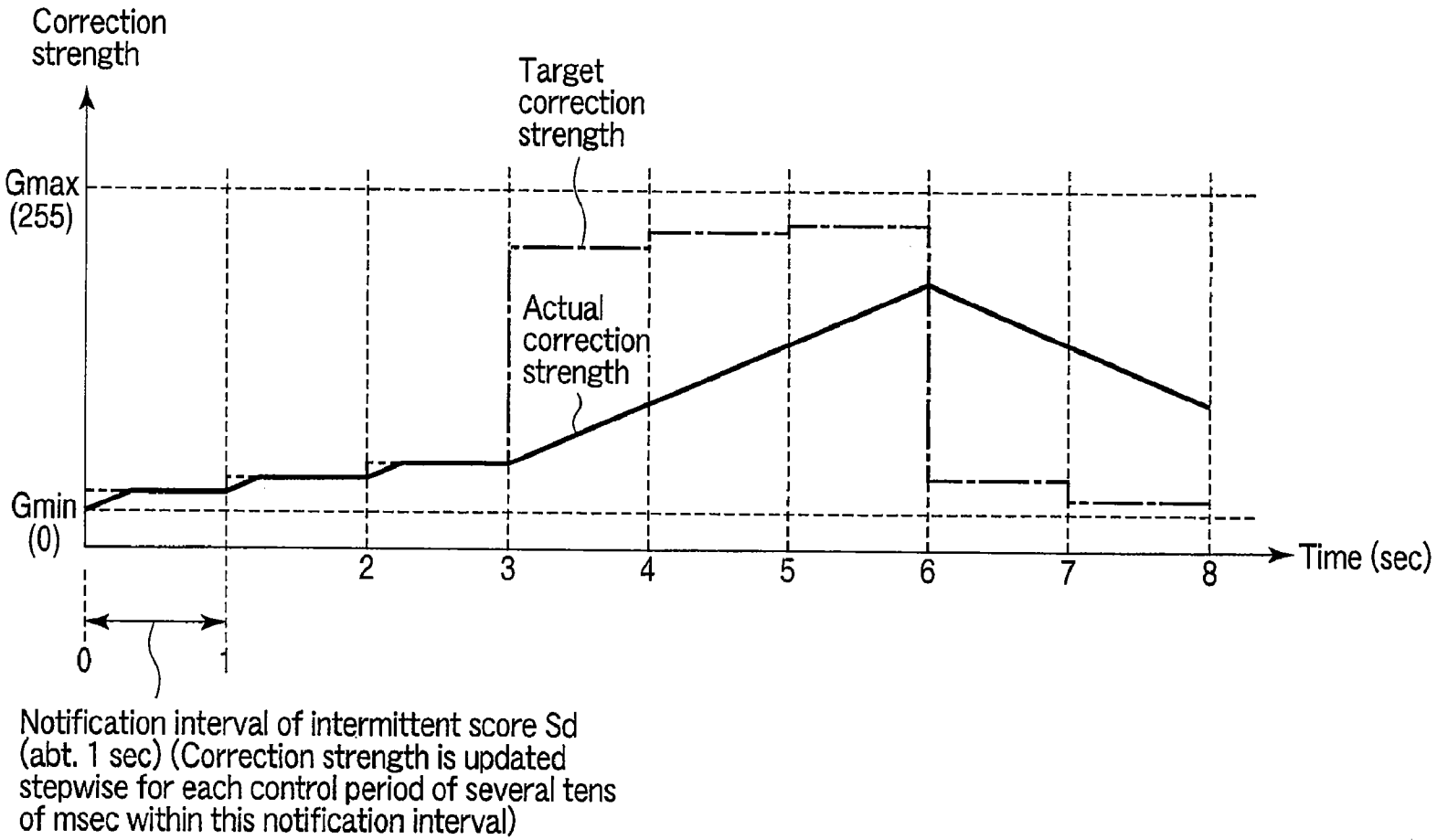
FIG. 15 is a diagram for describing the transition of the sound quality correction strength performed by the sound quality correction processing module according to the same embodiment.

FIG. 15 shows the manner in which the sound quality correction strength makes transition under the control of the mixing controller 88. Specifically, each time the intermittent score is notified, the target correction strength, as indicated by one-dot chain in FIG. 15, is updated within the range between the maximum correction strength Gmax and the minimum correction strength Gmin for every notification interval (about 1 sec) of the intermittent score Sd.

Within this notification interval, as indicated by solid line in FIG. 15, the correction strength is updated sequentially toward the target correction strength in units of the step width Gstep determined based on the transition time Ttrans for every predetermined control period Ton (several tens of milliseconds).

According to the embodiment described above, the first step is to analyze the feature amounts of the speech and the music from an input audio signal, followed by determining based on the feature parameters to which of the speech signal and the music signal the input audio signal is close to as a score, and upon determination that the input audio signal is close to the music, the previous score determination result is corrected taking the effect of the background sound into consideration.

Based on the score value thus corrected, the correction strength is controlled for each of plural types of sound quality correction elements (reverberation, wide stereo, center emphasis, equalization, etc.) while at the same time controlling the transition time to change the strength for each correction element. As a result, both the robustness (reduction in the subjective sense of incongruence) against the erroneous determination and the score variation and the correction effect can be improved at the same time.

Also, the intermittent score is generated by smoothing or adding by weighting a corrected score value within a predetermined notification interval, and based on this intermittent score, the target correction strength is updated intermittently for each predetermined notification interval. As a result, the communication band in terms of hardware or software between the speech/music/background sound identification processing system and the sound quality correction processing system can be reduced, thereby making it possible to reduce the processing load.

Further, although the reverberation, the wide stereo, the center emphasis and the equalization are cited above as the sound quality elements to be corrected according to the aforementioned embodiment, the sound quality correction is limited to these elements and can of course be carried out for various elements including the surround of which the sound quality is correctable.

The various modules of the systems described herein can be implemented as software applications, hardware and/or software modules, or components on one or more computers, such as servers. While the various modules are illustrated separately, they may share some or all of the same underlying logic or code.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A sound quality correction apparatus comprising:

a feature parameter calculator configured to calculate various feature parameters to identify a speech signal and a music signal from an input audio signal;

a speech/music identification score calculator configured to calculate a speech/music identification score indicating to which of the speech signal or the music signal the input audio signal is close to, based on the various feature parameters calculated by the feature parameter calculator;

a sound quality corrector configured to execute a plurality of sound quality correction processes of different types on the input audio signal; and a controller configured to control a correction strength for each of the sound quality correction processes executed by the sound quality corrector, based on the speech/music identification score calculated by the speech/music identification score calculator, the controller being configured to determine a target correction strength for each of the sound quality correction processes executed by the sound quality corrector based on the speech/music identification score, and to change a present correction strength stepwise toward the target correction strength for each of the sound quality correction processes executed by the sound quality corrector, based on a forward transition time and a backward transition time which are predetermined for each of the sound quality correction processes executed by the sound quality corrector.

2. The sound quality correction apparatus of claim 1, wherein the controller is configured to control the correction strength for each of the sound quality correction processes of different types executed by the sound quality corrector, based on the speech/music identification score at preset intervals.

3. The sound quality correction apparatus of claim 1, wherein the feature parameter calculator is configured to calculate various feature parameters to identify the music signal and the background sound signal from the input audio signal, the apparatus comprising:

a music/background sound identification score calculator configured to calculate a music/background sound identification score indicating to which of the music signal or the background sound signal the input audio signal is close to, based on the various feature parameters to identify the music signal and the background sound signal calculated by the feature parameter calculator; and a speech/music identification score corrector configured in such a manner that in the case where the speech/music identification score calculated by the speech/music identification score calculator indicates a music signal and the music/background sound identification score calculated by the music/background sound identification calculator indicates a background sound signal, then the speech/music identification score is corrected based on the value of the music/background sound identification score, wherein the controller is configured to control the correction strength for each of the sound quality correction processes executed by the sound quality corrector, based on the speech/music identification score corrected by the speech/music identification score corrector.

4. The sound quality correction apparatus of claim 1, wherein the controller includes a table describing correlations between the speech/music identification score and the correction strength determined for each of the sound quality correction processes executed by the sound quality corrector, and in the case where the speech/music identification score is input, the table is referred to and the correction strength for each of the sound quality correction processes executed by the sound quality corrector is determined.

5. The sound quality correction apparatus of claim 1, wherein the sound quality corrector is configured to execute at least one of the reverberation process, the wide stereo process, the center emphasis process, the equalization process and the surround process on the input audio signal.

6. A sound quality correction method comprising:

calculating various feature parameters to identify a speech signal and a music signal from an input audio signal;

calculating a speech/music identification score indicating to which of the speech signal or the music signal the input audio signal is close to, based on the calculated various feature parameters;

executing a plurality of sound quality correction processes of different types on the input audio signal;

controlling a correction strength for each of the sound quality correction processes executed by a sound quality corrector, based on the calculated speech/music identification score, the controlling comprising determining a target correction strength for each of the sound quality correction processes executed by the sound quality corrector based on the speech/music identification score, and changing a present correction strength stepwise toward the target correction strength for each of the sound quality correction processes executed by the sound quality corrector, based on a forward transition time and a backward transition time which are predetermined for each of the sound quality correction processes executed by the sound quality corrector.

7. A non-transitory computer readable medium having stored thereon a sound quality correction program which is executable by a computer, the sound quality correction program controlling the computer to execute the functions of:

calculating various feature parameters to identify a speech signal and a music signal from an input audio signal;

calculating a speech/music identification score indicating to which of the speech signal or the music signal the input audio signal is close to, based on the various feature parameters calculated; and controlling a correction strength for each of the sound quality correction processes executed by a sound quality corrector, based on the calculated speech/music identification score, the controlling comprising determining a target correction strength for each of the sound quality correction processes executed by the sound quality corrector based on the speech/music identification score, and changing a present correction strength stepwise toward the target correction strength for each of the sound quality correction processes executed by the sound quality corrector, based on a forward transition time and a backward transition time which are predetermined for each of the sound quality correction processes executed by the sound quality corrector.

* * * * *